US006648443B1

(12) United States Patent
Rausch et al.

(10) Patent No.: US 6,648,443 B1
(45) Date of Patent: Nov. 18, 2003

(54) THERMAL INKJET PRINT HEAD WITH A TEMPERATURE REGULATION SYSTEM AND METHODS OF MAKING AND USING THE SAME

(75) Inventors: John B. Rausch, Boise, ID (US); David A. Shade, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/174,294

(22) Filed: Jun. 18, 2002

(51) Int. Cl.[7] ..... B41J 29/38
(52) U.S. Cl. ..... 347/17
(58) Field of Search ..... 347/67, 17, 23, 347/14, 19, 5, 18, 61, 59, 7, 12, 10, 11, 60, 62, 68, 72; 438/21; 358/296

(56) References Cited

U.S. PATENT DOCUMENTS 5,175,565 A * 12/1992 Ishinaga et al. ..... 347/67
5,622,897 A 4/1997 Hayes
6,193,349 B1 * 2/2001 Cornell et al. ..... 347/18

* cited by examiner

*Primary Examiner*—Stephen D. Meier
*Assistant Examiner*—Charles W. Stewart, Jr.

(57) ABSTRACT

A thermal inkjet print head includes a temperature regulation system. The print head preferably includes a thermal inkjet print head and an array or array of Peltier devices in proximity to the thermal inkjet print head such that the array of Peltier devices can raise or lower the temperature of the thermal inkjet print head or components thereof.

14 Claims, 5 Drawing Sheets

THERMAL INKJET PRINT HEAD WITH A TEMPERATURE REGULATION SYSTEM AND METHODS OF MAKING AND USING THE SAME

FIELD OF THE INVENTION

The present invention relates to the field of thermal inkjet printing. More particularly, the present invention relates to the field of regulating temperature in a thermal inkjet print head.

BACKGROUND OF THE INVENTION

Inkjet printers work by spraying ink at a sheet of paper or other print medium to create images or text. Inkjet printers are capable of producing high quality print approaching that produced by laser printers. Inkjet printers are generally less expensive than laser printers, but can also be considerably slower.

To produce words or pictures contained in data received by a printer from a host computer or network, the inkjet printer squirts drops of ink through extremely tiny nozzles. Bundled together, the hundreds of nozzles form a print head, which travels across the paper printing a horizontal line of the image. The nozzles fire many times per second. After completing a line, the paper is advanced and the next strip of the image is printed. This continues until the page is complete.

Inkjet printers can also print in color by squirting colored inks onto the paper. Most inkjet printers use four hues of ink in the well-established color set used on color printing presses, i.e., cyan, magenta, yellow, and black, often abbreviated as CMYK.

There are two basic types of inkjet printers: thermal and piezo. Most inkjet printers use thermal inkjet technology, which heats the ink to create a bubble that forces a drop of ink out of the nozzle. Tiny resistors may be used to rapidly heat a thin layer of liquid ink causing the bubble to form. As the nozzle cools and the bubble collapses, it creates a vacuum that draws more ink from a cartridge to replace the ink that was ejected. This process is repeated thousands of times per second. The time required to heat and then cool the nozzle theoretically slows printing speeds.

In contrast, piezoelectric inkjet printing, commonly referred to simply as piezo, pumps ink through nozzles using pressure. The print head regulates the ink by means of an electrical current passed through a material that swells in response to the electrical current to force ink onto the paper. Piezo print heads require vacuum pumps and large ink-absorbent pads to keep nozzles printing reliably. Piezo mechanical stability is also highly sensitive to small air bubbles, and the system may also need flushing with ink to purge trapped air, a process that wastes ink.

The present invention relates to thermal inkjet printing. Thermal inkjet performance can vary widely due to the temperature of the ink firing chamber and the ejected ink. Controlling temperature in a thermal inkjet printer is important in order to guarantee consistently good image print quality. This is due to changes in the physical characteristics of the ink, the nucleation dynamics of the ink and the refill characteristics of a thermal inkjet print head, all of which can vary with temperature. The print head temperature can vary due to ambient temperature, servicing (spitting) and the amount of printing being done with the print head.

Heating the print head before the start of the printing swath has been attempted to control temperature. This method has the disadvantage of having to predict the required temperature and adjust the delivered heat at the start of the printing zone to compensate for all possible changes of temperature during the printing swath. Temperature variations can be significant and very difficult to predict.

SUMMARY OF THE INVENTION

In one embodiment, the present invention may be described as a thermal inkjet print head with a temperature regulation system. The print head preferably includes a thermal inkjet print head and an array of Peltier devices in proximity to the thermal inkjet print head such that the array of Peltier devices can raise or lower the temperature of the thermal inkjet print head or components thereof.

In another possible embodiment, the present invention may be described as a thermal inkjet printing device with a temperature regulation system for a print head of that printing device. The printing device preferably includes a thermal inkjet print head and an array of Peltier devices in proximity to the thermal inkjet print head such that the array of Peltier devices can raise or lower a temperature of the thermal inkjet print head or components thereof.

The present invention also encompasses a method of regulating the temperature of a thermal inkjet print head by selectively heating or cooling the inkjet print head or components thereof with an array of Peltier devices.

The present invention also encompasses a method of making a thermal inkjet print head by forming a thermal inkjet print head, and forming an array of Peltier devices in proximity to the print head for regulating an operating temperature of the print head.

BRIEF DESCRIPTION OF THE DRAWINGS

The accompanying drawings illustrate embodiments of the present invention and are a part of the specification. Together with the following description, the drawings demonstrate and explain the principles of the present invention. The illustrated embodiments are examples of the present invention and do not limit the scope of the invention.

Throughout the drawings, identical reference numbers designate similar, but not necessarily identical, elements.

DETAILED DESCRIPTION OF EMBODIMENTS OF THE INVENTION

Figure 1:
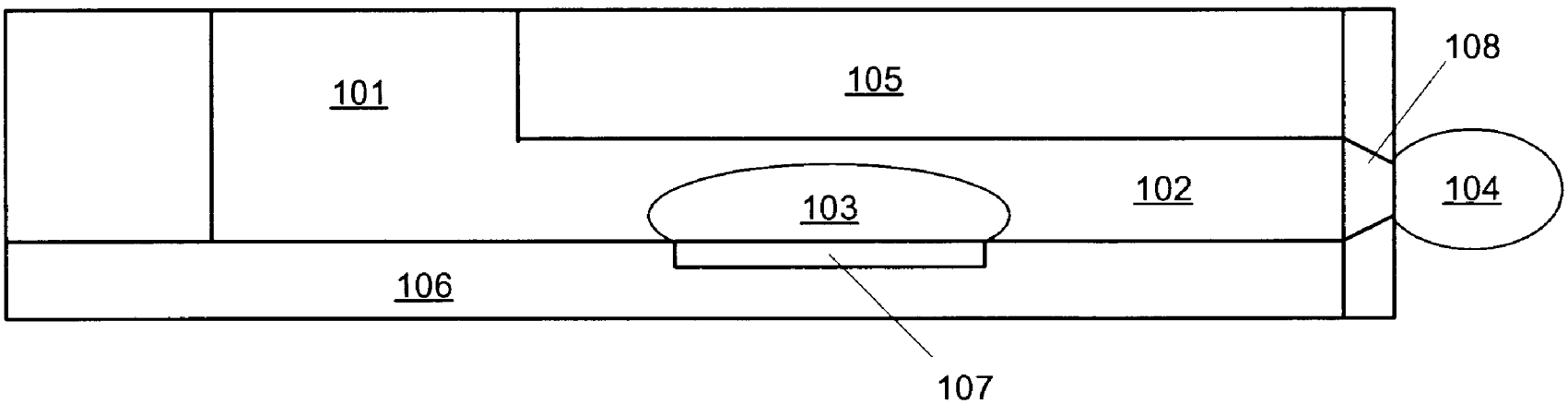
FIG. 1 is a basic diagram of a thermal inkjet print head within which the present invention could be practiced.

FIG. 1 illustrates a thermal inkjet print head with which the present invention could be practiced. As shown in FIG. 1, the print head (105) includes multiple inkjet nozzles (108) formed on a common substrate (106). Associated with each nozzle (108) is a heating element (107), for example, a resistor. The nozzle (108) is connected to a nozzle chamber (102) within which the heating resistor (107) is located.

To fire ink from the nozzle chamber (102) a drive system on the substrate (106) outputs a firing pulse to the heating resistor (107). The firing pulse is, for example, a current pulse of sufficient magnitude to heat up the resistor (107) enough to heat the ink to a firing temperature. At this temperature, a bubble (103) forms in the ink at the heating resistor (107). The expansion of this bubble (103) forces a drop of ink (104) out the nozzle (108). The ink (104) ejects from the nozzle (108) toward a print media sheet.

After the heating resistor (107) has been fired, the bubble (103) collapses as the resistor (107) cools. This creates a vacuum that pulls more ink from an ink cartridge or supply through an inlet (101) into the nozzle chamber (102). The nozzle (108) is then ready to fire again when the resistor (107) is heated. A controller circuit (not shown) determines when any given nozzle is to fire based on the data that defines the image or text being printed by the print head (105).

As noted above, thermal inkjet performance can vary widely due to the temperature of the nozzle chamber and the ejected ink. Controlling temperature in a thermal inkjet print head is important to guarantee consistently good image print quality. Additionally, the time required to heat the ink in the nozzle chamber to eject an ink drop and then cool the ink to ready the nozzle to fire again limits the speed of the print head.

Consequently, an effective system for controlling the temperature of the thermal inkjet print head to maintain the temperature of the print head within an optimal operating range will promote a uniform and high image quality from the printer. Additionally, a temperature system than can selectively promote the heating and cooling of the print head as it fires and then prepares to fire again can increase the printing speed of the printer. Such a temperature regulation system is provided by the present invention.

It should be noted that the thermal inkjet print head illustrated is a side-firing configuration. Top-firing configurations, in which the heating element is vertically under the nozzle are also popular. The present invention can be practiced with any thermal inkjet configuration.

Figure 2:
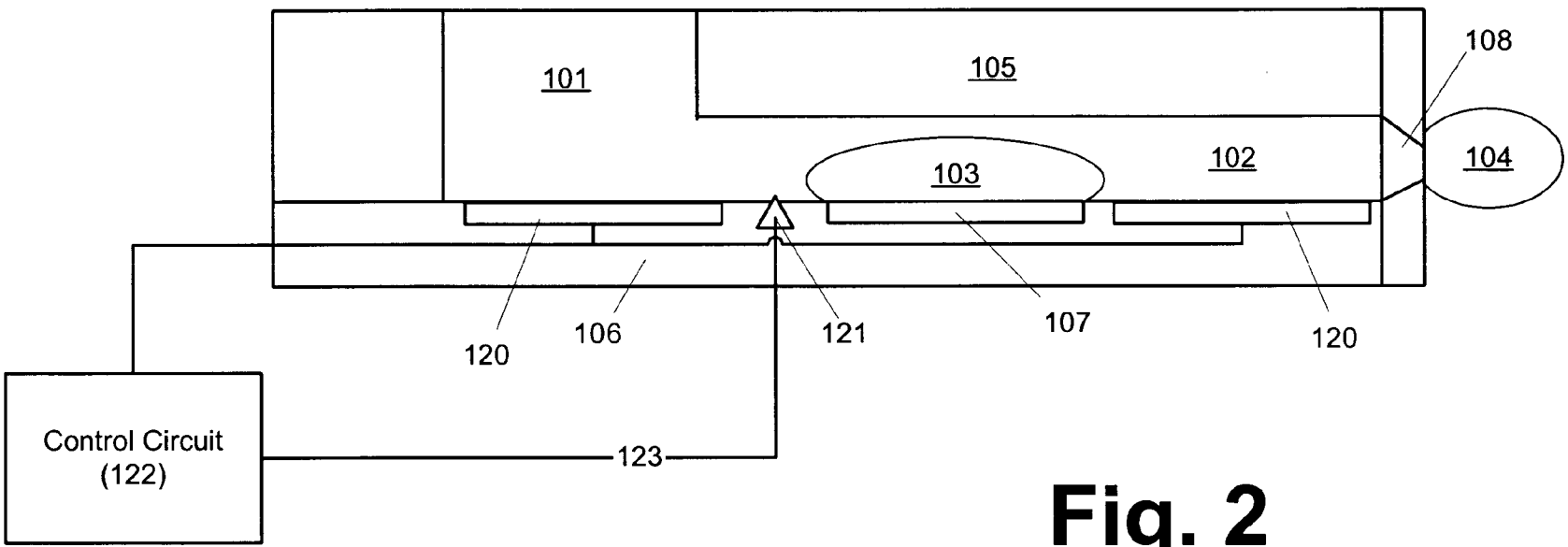
FIG. 2 is a diagram of a thermal inkjet print head with a temperature regulating system according to one embodiment of the present invention.

FIG. 2 is a diagram of a thermal inkjet print head with a temperature regulating system according to one embodiment of the present invention. As shown in FIG. 2, a thermal inkjet print head (105) according to the present invention may include multiple inkjet nozzles (108) formed on a common substrate (106). Associated with each nozzle (108) is a heating element (107), for example, a resistor. Each nozzle (108) is connected to a nozzle chamber (102) within which the respective heating element (107) is located.

To fire ink from the nozzle chamber (102) a drive system on the substrate (106) outputs a firing pulse to the heating element (107). The firing pulse causes the heating element (107) to heat up enough to heat the surrounding ink to a firing temperature. At this temperature, a bubble (103) forms in the ink in the vicinity of the heating element (107). The expansion of this bubble,(103) forces a drop of ink (104) out the nozzle (108).

After the heating element (107) has been fired and begins to cool, the bubble (103) collapses. The collapse of the bubble (103) creates a vacuum that pulls more ink from an ink cartridge or supply through an inlet (101) into the nozzle chamber (102). When ink has refilled the nozzle chamber (102) and regained a liquid state, the nozzle (108) is ready to fire again.

Additionally, the inkjet print head (105) of FIG. 2 includes a temperature regulation system to maintain and control the temperature and temperature changes within the ink jet print head (105). This temperature regulation system preferably includes an array or arrays of Peltier junctions (120).

A Peltier junction or "Peltier device" is a form of thermocouple. Two different materials are sandwiched together to form a Peltier junction. When an electrical current is applied to the Peltier device, a temperature difference is created across the device. One side of the Peltier device becomes hotter than room temperature, while the other side becomes cooler. The hot and cold sides can be reversed by switching the direction of the electrical current applied to the Peltier device. Consequently, a Peltier device can be used to selectively heat or cool an area or structure where the device is located by controlling the direction of current applied to the Peltier device.

According to principles of the present invention, an array or arrays of Peltier devices are added to a thermal inkjet print head to selectively regulate the temperature of the print head. This temperature regulation can be used to maintain the print head within an optimal operating temperature range. The temperature regulation can also be used to increase the print speed of the print head by promoting the heating and cooling cycle required for print head operation.

In the embodiment shown in FIG. 2, an array of Peltier device (120) is formed on the substrate (106) of the thermal inkjet print head (105). This allows the Peltier array (120) to be in proximity to the ink channel (101) and nozzle chamber (102). Consequently, the Peltier array (120) can effectively heat or cool the operating structure of the print head (105) to promote print head operation.

Within the present invention, the Peltier array (120) may be collected in a single location or may consists of groupings of Peltier devices (120) at different locations within or adjacent to the print head (105), as shown in FIG. 2.

A temperature sensor (121) may also be formed in or on the substrate (106). This temperature sensor (121) outputs a signal (123) indicative of the temperature within the print head structure (105). The precise location of the temperature sensor (121) can be selected depending on the temperature variable of the print head that one is trying to optimize. This will be understood by those skilled in the art with the benefit of this disclosure.

The signal (123) from the temperature sensor (121) is received by a control circuit (122) that also drives the Peltier array (120). The control circuit (122) will determine, based on the signal (123) from the temperature sensor (121), if the print head structure (105) is within an optimal temperature range for printing. If not, the control circuit (122) can supply current to the Peltier array (120) to heat or cool the print head structure (105). The Peltier array (120) will heat or cool the print head structure (105) depending on the direction of current supplied by the control circuit (122).

Figure 3:
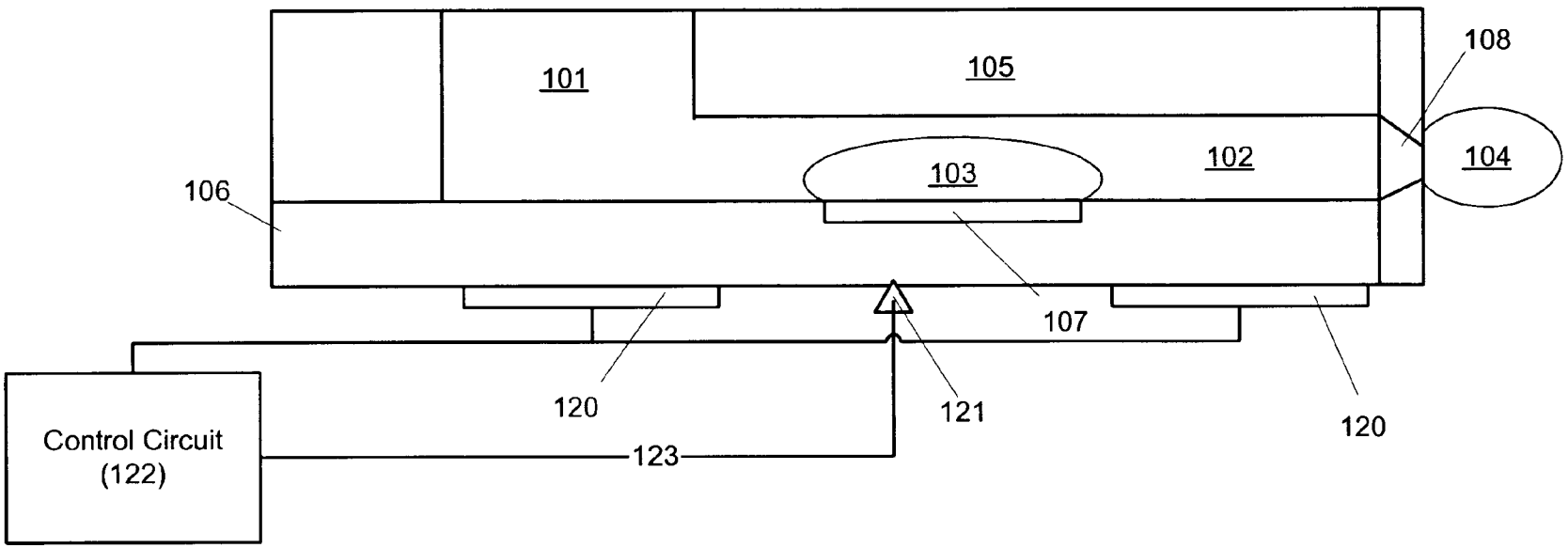
FIG. 3 is a diagram of a thermal inkjet print head with a temperature regulating system according to another embodiment of the present invention.

FIG. 3 is a diagram of a thermal inkjet print head with a temperature regulating system according to another embodiment of the present invention. As demonstrated by FIG. 3, the Peltier array (120) of the present invention can be located at a wide variety of positions within or in proximity to the print head structure (105).

For example, FIG. 3 illustrates the Peltier array (120) formed on the opposite side of the print head substrate (106) from the nozzle chamber (102) and heating element(107). The Peltier array (120) can still effectively regulate the temperature of the print head structure (105) if located as is illustrated in FIG. 3. Many other locations for the Peltier array (120) within or in proximity to the print head structure (105) are effective for regulating the temperature of the print head structure (105) and are within the scope of the present invention. And, again, the Peltier array (120) may consist of one or more groupings of Peltier devices strategically located to regulate the temperature of the print head or components thereof, such as the nozzle chamber (102), substrate (106), etc.

Figure 4:
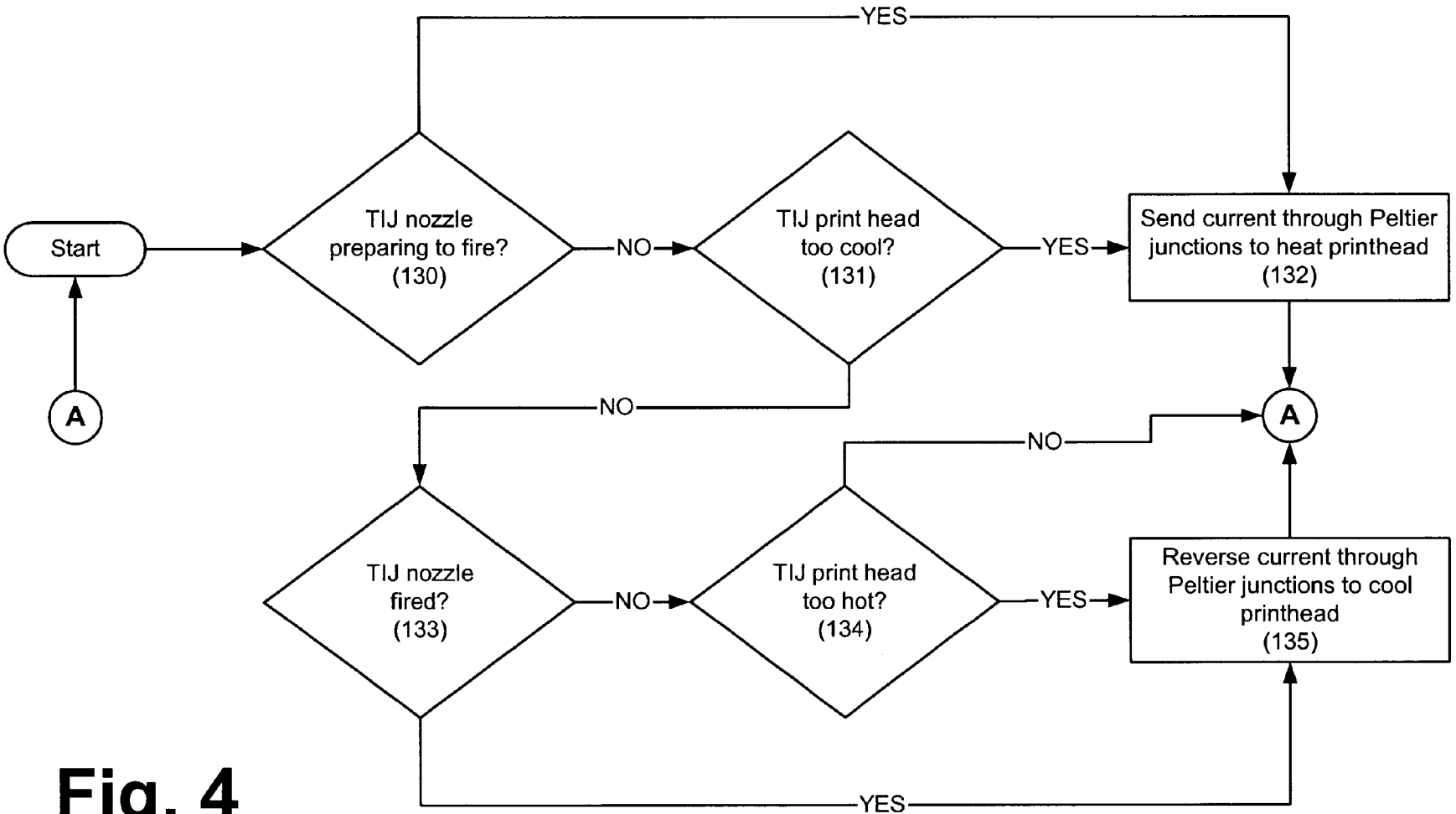
FIG. 4 is flowchart illustrating temperature regulation of a thermal inkjet print head according to principles of the present invention.

FIG. 4 is flowchart illustrating temperature regulation of a thermal inkjet (TIJ) print head according to principles of the present invention. As shown in FIG. 4, if a nozzle of the thermal inkjet print head is preparing to fire (130), the temperature regulation system of the present invention may send current through a Peltier device or array of Peltier devices to more rapidly increase the temperature in the nozzle chamber to allow that nozzle to fire sooner (132). Additionally or alternatively, if the print head structure is too cool (131), i.e., cooler than an optimal operating temperature range, current may be sent to the Peltier device or array to increase the overall temperature of the print head structure (132).

Alternatively, if a nozzle of the thermal inkjet print head has just fired, it may be desirable to cool the corresponding nozzle chamber and the ink therein to more rapidly return the nozzle to a condition in which it is ready to fire (133). This can be done by revering the current applied to the Peltier device or array so that the Peltier device or array cools the nozzle chamber and or the ink therein (135). Additionally or alternatively, if the print head structure is generally too hot (134), i.e., hotter than an optimal operating temperature range, the reversed current may be applied to the Peltier device or array to cool the print head structure (135).

These processes operate continually to maintain the print head within an optimal operating temperature range and or to promote the speed of the heating and cooling cycle on which operation of the print head depends. The continuity of these processes is represented in FIG. 4 by "A" which loops the process to indicate continuous iteration. Thus, the regulation method illustrated in FIG. 4 preferably stops only when the printing device is deactivated.

Figure 5:
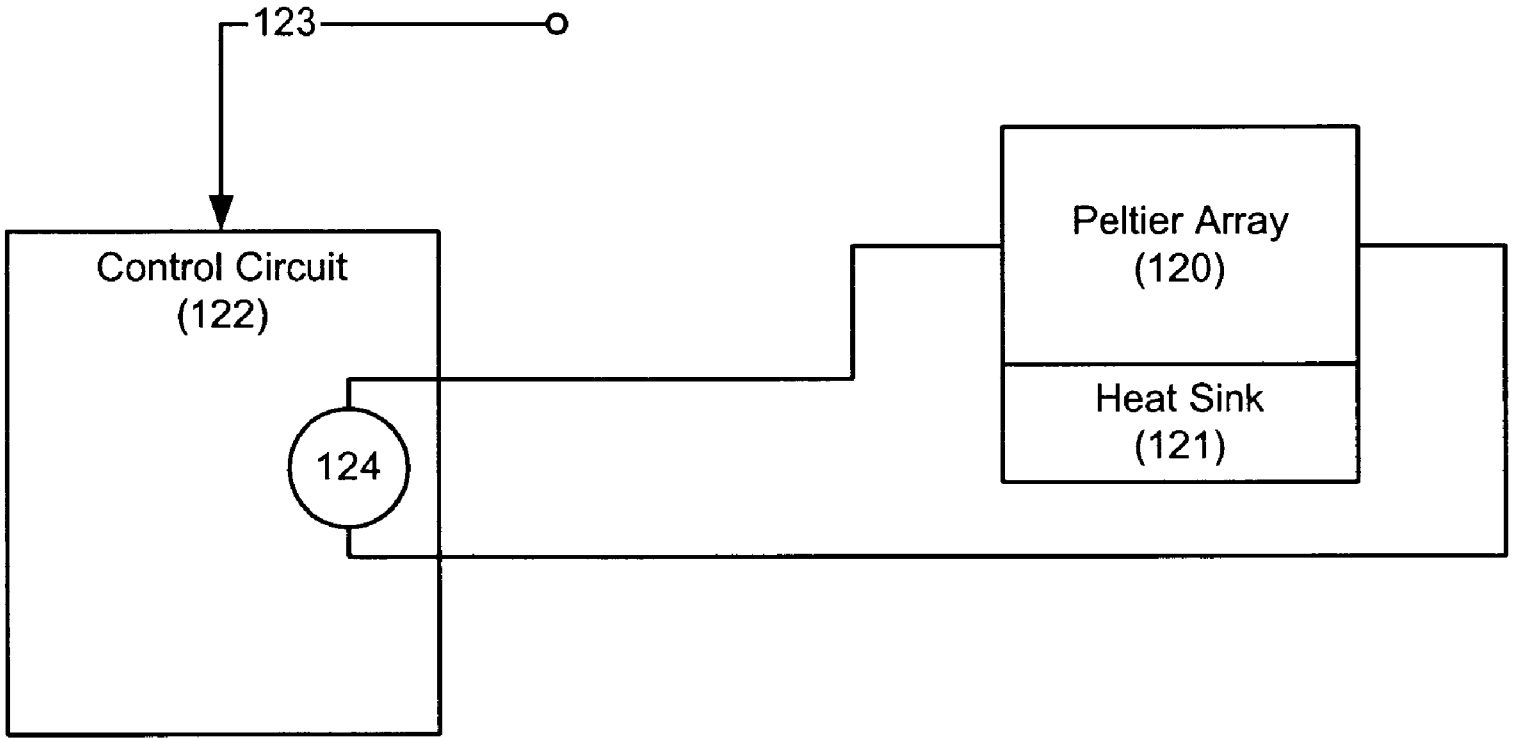
FIG. 5 is a diagram of a temperature regulation system for a thermal inkjet print head according to another embodiment of the present invention.

FIG. 5 is a more detailed diagram of a temperature regulation system for a thermal inkjet head according to another embodiment of the present invention. As shown in FIG. 5, the control circuit (122) that controls the Peltier array (120) receives a signal (123) indicative of the temperature within critical areas of the thermal inkjet print head. Based on that signal, the control circuit (122) selectively supplies current to the Peltier array (120) to cause the array (120) to heat or cool the print head and/or individual nozzle chamber.

A current source (124) may be included in the control circuit (122) or may otherwise be controlled by the control circuit (122). The current source (124) is capable of selectively providing a current flow to the Peltier array (120) or to individual Peltier devices in either of two possible directions. Thus, under control of the control circuit (122), the current source (124) applies a forward or reverse current to the Peltier array (120) or individual Peltier devices to selectively heat or cool the print head structure or components thereof that are adjacent to the array (120).

Where the array (120) is pulling heat from the print head structure, a heat sink (121) may be thermally coupled to the array (120) to dispose of excess heat generated by or pulled from the print head structure by the array (120). The heat sink (121) may be any form of heat sink for disposing of heat produced by the array (120) during operation of the array (120) as described herein. The heat sink may also dispose of waste heat by exchanging heat into the ink or fluid being used by the print head. This can be done by exchanging heat into the ink/fluid delivery path, exit path or supply path.

Consequently, as described above, a system according to the principles of the present invention provides a means to moderate the temperature of a thermal inkjet printing device or print head. The array of Peltier junctions can be placed on the substrate of the thermal inkjet print head, or in close proximity to the substrate, orifice plate, ink feed path, etc. The array is then used to regulate the temperature of the print head structure using the Peltier junction effect to heat or cool the device depending on the direction of current flow applied to the array. This helps provide the optimal temperature for thermal ink jet print head performance.

Preferably, a temperature sensor is incorporated into the thermal inkjet print head structure, or in proximity thereto. The temperature sensor allows the system to adjust the temperature of the print head for optimal performance under varying conditions, such as ambient temperature, printing volume, etc.

The Peltier devices may be attached or deposited on the substrate of the inkjet print head, preferably on the backside of the substrate or in close proximity to the print head for maximum heat transfer efficiency.

Alternatively, the Peltier devices may be used to moderate the temperature of the ink or fluid itself to compensate for environmental effects or to optimize the hydraulic performance of the ink or fluid, independent of the thermal inkjet device. As noted above, heat must be added to raise the temperature of the thermal inkjet print head near the critical temperature required to nucleate the ink or fluid to eject a drop. Then, the temperature must be reduced as fast as possible to restore the liquid sate of the ink or fluid to prepare the nozzle to fire again and iterate the process of ejecting a drop.

It should also be noted that the Peltier devices of the present invention can be used in a thermal printing device, as opposed to a thermal inkjet printing device. A thermal printing device uses heat to cause changes in a print medium that create the desired text or image thereon.

In a thermal printing device, the Peltier devices of the present invention can be used to maintain the optimal operating temperature of the thermal print head or to achieve an optimal temperature for the print medium. For example, heat may be applied using the Peltier devices to raise the temperature of the print medium, e.g., paper, to the critical temperature necessary to activate the chemical transition thereby creating a dot or mark on the paper. Heat may also be applied to reach the incremental temperature thresholds required for temperature-sensitive, multi-color thermal printing. Ultimately, the operating speed of a thermal printer may be limited by excess heat in the device itself or non-optimal temperature of the print medium. The Peltier array of the present invention can address either issue.

It will be noted by those skilled in the art that the temperature regulation system of the present invention can be incorporated in any thermal inkjet printing system. For example, the temperature regulation system of the present invention may be incorporated in a thermal inkjet printing system in a printer, facsimile machine, copier, multi-function peripheral, etc. All such devices, and the like, may be referred to herein collectively as "printing devices."

The foregoing embodiments have been described as examples of the present invention. The present invention is not limited to any or all of the preceding embodiment, but is defined by the scope of the following claims.

What is claimed is:

1. A thermal inkjet print head comprising a temperature regulation system, said print head comprising:

a thermal inkjet print head;

an array of Peltier devices in proximity to said thermal inkjet print head such that said array of Peltier devices can raise or lower a temperature of said thermal inkjet print head or components thereof;

a temperature sensor in proximity to said thermal inkjet print head for outputting a signal indicative of temperature; and a control circuit for receiving said signal indicative of temperature, said control circuit selectively applying current to said array of Peltier device to heat or cool said thermal inkjet print head in response to said signal indicative of temperature.

2. The print head of claim 1, wherein said array of Peltier devices further comprises a heat sink.

3. The print head of claim 1, wherein said array of Peltier devices is disposed on a substrate of said thermal inkjet print head.

4. The print head of claim 3, wherein said array of Peltier devices is disposed on said substrate of said thermal inkjet print head on a side of said substrate opposite a side supporting a heating element and nozzle chamber.

5. The print head of claim 1, wherein said array of Peltier devices is disposed adjacent a substrate of said thermal inkjet print head.

6. A thermal inkjet printing device comprising a temperature regulation system for a print head of said printing device, said printing device comprising:

a thermal inkjet print head;

an array of Peltier devices in proximity to said thermal inkjet print head such that said array of Peltier devices can raise or lower a temperature of said thermal inkjet print head or components thereof;

a temperature sensor in proximity to said thermal inkjet print head for outputting a signal indicative of temperature; and a control circuit for receiving said signal indicative of temperature, said control circuit selectively applying a current to said array of Peltier device to heat or cool said thermal inkjet print head in response to said signal indicative of temperature.

7. The printing device of claim 6, wherein said array of Peltier devices further comprises a heat sink.

8. The printing device of claim 6, wherein said array of Peltier devices is disposed on a substrate of said thermal inkjet print head.

9. The printing device of claim 8, wherein said array of Peltier devices is disposed on said substrate of said thermal inkjet print head on a side of said substrate opposite a side supporting a heating element and nozzle chamber.

10. The printing device of claim 6, wherein said array of Peltier devices is disposed within said printing device adjacent a substrate of said thermal inkjet print head.

11. A method of making a thermal inkjet print head, said method comprising:

forming a thermal inkjet print head;

forming an array of Peltier devices in proximity to said print head for regulating an operating temperature of said print head;

forming a control circuit connected to said Peltier array for selectively applying a current in one of two directions to said Peltier array; and forming a temperature sen,or in said inkjet print head, said temperature sensor being connected to said control circuit for supplying a signal indicative to temperature to said control circuit, said control circuit applying said current in one of said two direction in response to said signal indicative of temperature.

12. The method of claim 11, further comprising disposing said array of Peltier devices on a substrate of said thermal inkjet print head.

13. The method of claim 12, further comprising disposing said array of Peltier devices on said substrate of said thermal inkjet print head on a side of said substrate opposite a side supporting a heating element and nozzle chamber.

14. The method of claim 11, further comprising disposing said array of Peltier devices adjacent a substrate of said thermal inkjet print head.

* * * * *

UNITED STATES PATENT AND TRADEMARK OFFICE

CERTIFICATE OF CORRECTION

PATENT NO. : 6,648,443 B1
DATED : November 18, 2003
INVENTOR(S) : Rausch et al.

It is certified that error appears in the above-identified patent and that said Letters Patent is hereby corrected as shown below:

Title page,
Item [57], ABSTRACT,
Line 3, delete “or array” and insert thereof -- or arrays --;

Column 8,
Line 26, delete “sen,or” and insert thereof -- sensor --;
Line 30, delete “direction” and insert thereof -- directions --.

Signed and Sealed this

Ninth Day of March, 2004

JON W. DUDAS
*Acting Director of the United States Patent and Trademark Office*